US005611625A

United States Patent [19]

Legendre

[11] Patent Number: 5,611,625

[45] Date of Patent: Mar. 18, 1997

[54] MULTIPURPOSE BAG

[76] Inventor: Michel L. Legendre, 57 Michaud, Gatineau, Québec, Canada, J8T 2W9

[21] Appl. No.: 534,412

[22] Filed: Sep. 27, 1995

[30] Foreign Application Priority Data

Dec. 28, 1994 [CA] Canada ..... 2139143

[51] Int. Cl.[6] ..... B65D 30/10

[52] U.S. Cl. ..... 383/4; 383/13; 383/38; 190/2; 190/8; 5/417

[58] Field of Search ..... 383/4, 13, 38; 190/1, 2, 8, 107; 5/417

[56] References Cited

U.S. PATENT DOCUMENTS

| | | | |
|---|---|---|---|
| 1,971,395 | 8/1934 | Danner | 383/110 X |
| 3,179,465 | 4/1965 | Roberts . | |
| 3,202,193 | 8/1965 | Ware | 383/4 X |
| 3,532,378 | 10/1970 | Dalia . | |
| 3,777,862 | 12/1973 | Zipper | 190/107 |
| 4,157,134 | 6/1979 | Stoll . | |
| 4,466,516 | 9/1984 | Sicoli et al. . | |
| 4,468,810 | 9/1984 | Longo . | |
| 4,489,815 | 12/1984 | Martinez et al. . | |
| 4,516,668 | 5/1985 | Grayek . | |
| 4,671,393 | 6/1987 | Rainey | 383/4 X |
| 4,723,300 | 2/1988 | Aranow . | |
| 4,789,247 | 12/1988 | Schnoor . | |
| 4,854,732 | 8/1989 | Italici . | |
| 4,984,906 | 1/1991 | Little . | |
| 5,048,975 | 9/1991 | Holbrook . | |
| 5,110,219 | 5/1992 | Lopes . | |

*Primary Examiner*—Jes F. Pascua
*Attorney, Agent, or Firm*—Jones, Tullar & Cooper, P.C.

[57] ABSTRACT

A multipurpose bag includes top and bottom sections fastenable to one another. The top section is convertible to a mattress whereas the bottom section is convertible to a mattress or a chair. The top and bottom sections are provided with pockets for receiving insert material which functions as cushioning and/or provides flotation capabilities therefor.

9 Claims, 5 Drawing Sheets

MULTIPURPOSE BAG

FIELD OF THE INVENTION

The present invention relates to a multipurpose bag and is particularly concerned with a bag convertible to both a mattress and a chair.

BACKGROUND OF THE INVENTION:

Outdoor activities, such as camping, canoeing, canoe-camping or spending a day at the beach, usually require a fair number of items to be carried along. In order to minimize the amount of luggage, multipurpose bags have been found convenient.

Prior art multipurpose bags typically include either a bag convertible to a chair or a bag convertible to a mattress. U.S. Pat. No. 3,179,465 issued on Apr. 20, 1965 to Roberts discloses a suitcase/chair combination. The suitcase includes two major sections and an end wall. Each of the major sections are hinged along one of their transverse edges to one of the longitudinal edges of the end wall. Each of the sections includes corresponding top, bottom and side flanges extending perpendicularly from their top and bottom longitudinal edges and transverse right edge, respectively. When the suitcase is in the closed position, the corresponding flanges abut one another so as to form a rectangular suitcase. To obtain the chair configuration, the suitcase is unfolded and extended in a longitudinal direction. In this position, the flanges point downwardly. The major sections become a seat and a back with the end wall being intermediate therebetween. The chair is provided with a pair of legs for supporting the seat and back in firm, spaced relation with respect to a ground surface. The chair also includes a pair of arms and a foot rest. While the suitcase can be converted to a chair its structure is complex and may be difficult to manufacture and maintain.

U.S. Pat. No. 4,984,906 issued on Jan. 15, 1991 to Little discloses a multipurpose utility tote bag. The tote bag is convertible to a flat, cushioned surface when fully opened. The device includes two rectangular sections which are joined to form a flat, T-shaped unit having side flaps extensible transversely to form a rectangular configuration. A zipper chain is provided along the entire periphery of the T-shaped unit. A single slide fastener for connecting the mating sections of the zipper chain is provided at one of the internal corner of the T-shaped unit. To transform the tote bag into the flat T-shaped surface, the fastener is pulled along the outer periphery of the T-shaped unit from one internal corner to the next internal corner. To transform the apparatus back into the tote bag configuration, the fastener is moved back to its original position. However such apparatus cannot be converted to a chair.

There is therefore a need for a bag which can be converted into both a chair and a mattress and which avoids the above disadvantages.

SUMMARY OF THE INVENTION

An object of the present invention is to provide a bag which can be converted into both a mattress and a chair. It is another object of the present invention to provide a bag convertible into two mattresses.

It is another object of the present invention to provide a bag which can float in water.

It is another object of the present invention to provide a multipurpose bag which is easy and simple to manufacture.

In accordance with one aspect of the present invention there is provided a multipurpose bag comprising: a top section convertible to a first mattress comprising spaced apart first and second parallel fold lines defining a first, second and third top area, the second top area being disposed between the first and third top area, the first top area having substantially the same size and shape as the third top area, the top section includes a first perimeter; a bottom section convertible to a chair or a second mattress comprising spaced apart third and fourth parallel fold lines defining a first, second and third bottom area, the third bottom area having an upper end, the second bottom area being disposed between the first and third bottom area, the first bottom area having substantially the same size and shape as the third bottom area, the bottom section includes a second perimeter; fastening means disposed along the first and second perimeters for fastening the top section to the bottom section so as to form a bag; strap means including removable handle portions for carrying the bag and strap portions disposed on the second bottom area; and a side strap disposed on the upper end of the third bottom area for connecting to the strap means so as to retain the third bottom area in a generally perpendicular position relative to the first and second bottom areas to form a chair, the side strap and strap means being sufficiently strong and disposed in such a manner as to prevent the chair from folding when in use.

In accordance with another aspect of the invention there is provided a multipurpose bag comprising: a generally U-shaped top section convertible to a first mattress comprising a planar top and foldable planar top sides extending downwardly from the planar top, the top sides having substantially the same size and shape, the top section includes a first perimeter; a generally U-shaped bottom section convertible to a chair or a second mattress comprising a planar bottom and foldable first and second planar bottom sides extending upwardly from the planar bottom, the foldable first and second planar bottom sides having substantially the same size and shape, the second foldable planar bottom side having an upper end, the bottom section includes a second perimeter; wherein the bottom and top sections complement one another so as to provide a generally parallelepiped enclosure; fastening means disposed along the first and second perimeters for fastening the top section to the bottom section so as to form a bag; strap means including removable handle portions for carrying the bag and strap portions disposed on the planar bottom; and a side strap disposed on the upper end of the second foldable planar bottom side for connecting to the strap means so as to retain the second foldable planar bottom side in a generally perpendicular position relative to the planar bottom to form a chair, the side strap and strap means being sufficiently strong and disposed in such a manner as to prevent the chair from folding when in use.

In accordance with another aspect of the invention there is provided a multipurpose bag comprising: a top section convertible to a first mattress comprising spaced apart first and second parallel fold lines defining a first, second and third top area, the second top area being disposed between the first and third top area, the first top area having substantially the same size and shape as the third top area, the top section includes a first perimeter; a bottom section convertible to a second mattress comprising spaced apart third and fourth parallel fold lines defining a first, second and third bottom area, the second bottom area being disposed between the first and third bottom area, the first bottom area having substantially the same size and shape as the third bottom area, the bottom section includes a second perimeter; fastening means disposed along the first and second perimeters for fastening the top section to the bottom section so as to form a bag; and strap means including removable handle portions for carrying the bag and strap portions disposed on the second bottom area.

BRIEF DESCRIPTION OF THE DRAWINGS:

An embodiment of the present invention will now be described by way of examples with reference to the following drawings in which.

Similar numeral references are used in different figures to denote similar components.

DETAILED DESCRIPTION OF THE PREFERRED EMBODIMENT

Referring to FIGS. 1 to 4, there is illustrated a multipurpose bag in accordance with the preferred embodiment of the present invention.

Figure 1:
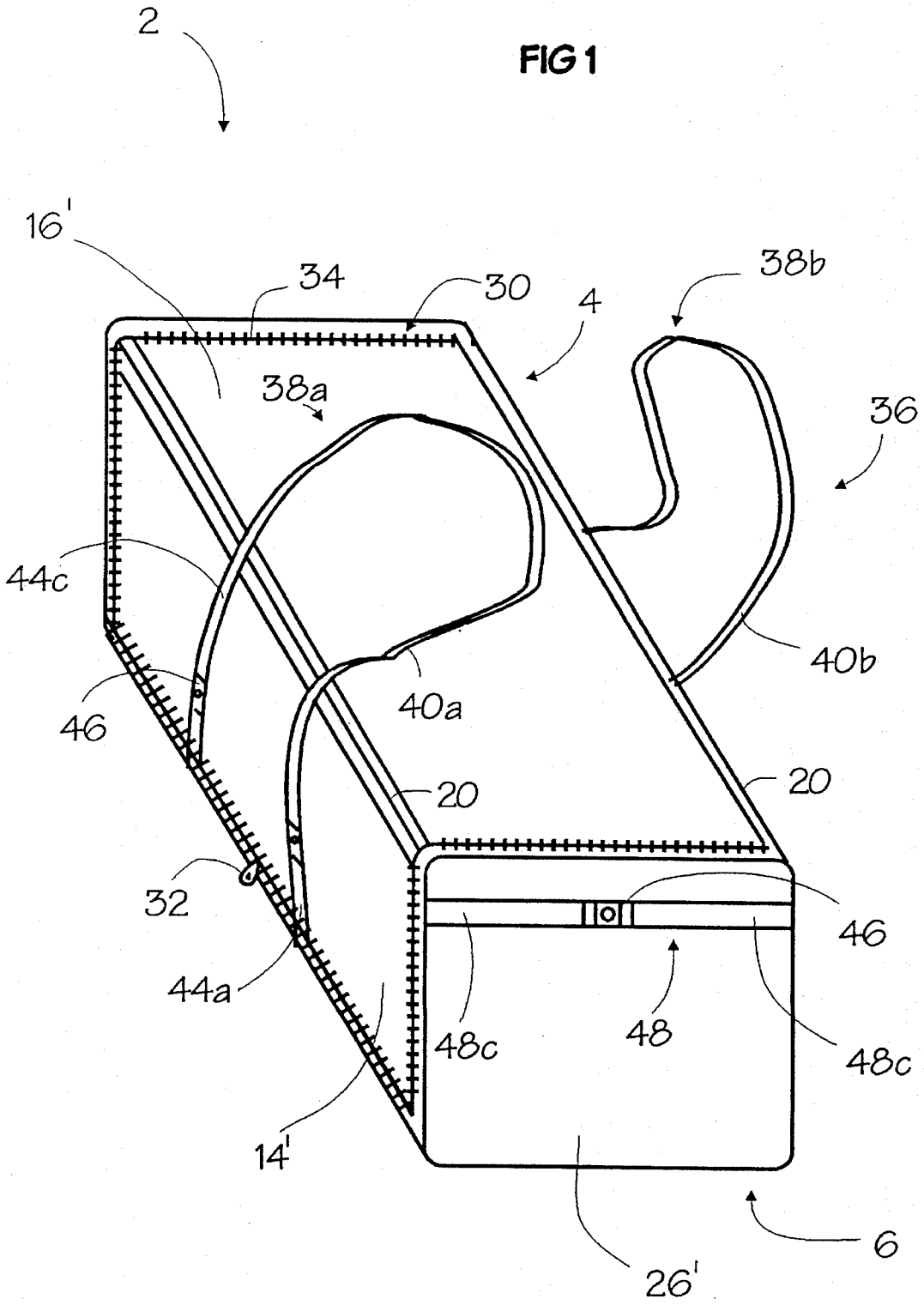
FIG. 1: illustrates, in a perspective view, a multipurpose bag in accordance with an embodiment of the present invention.
Figure 2A:
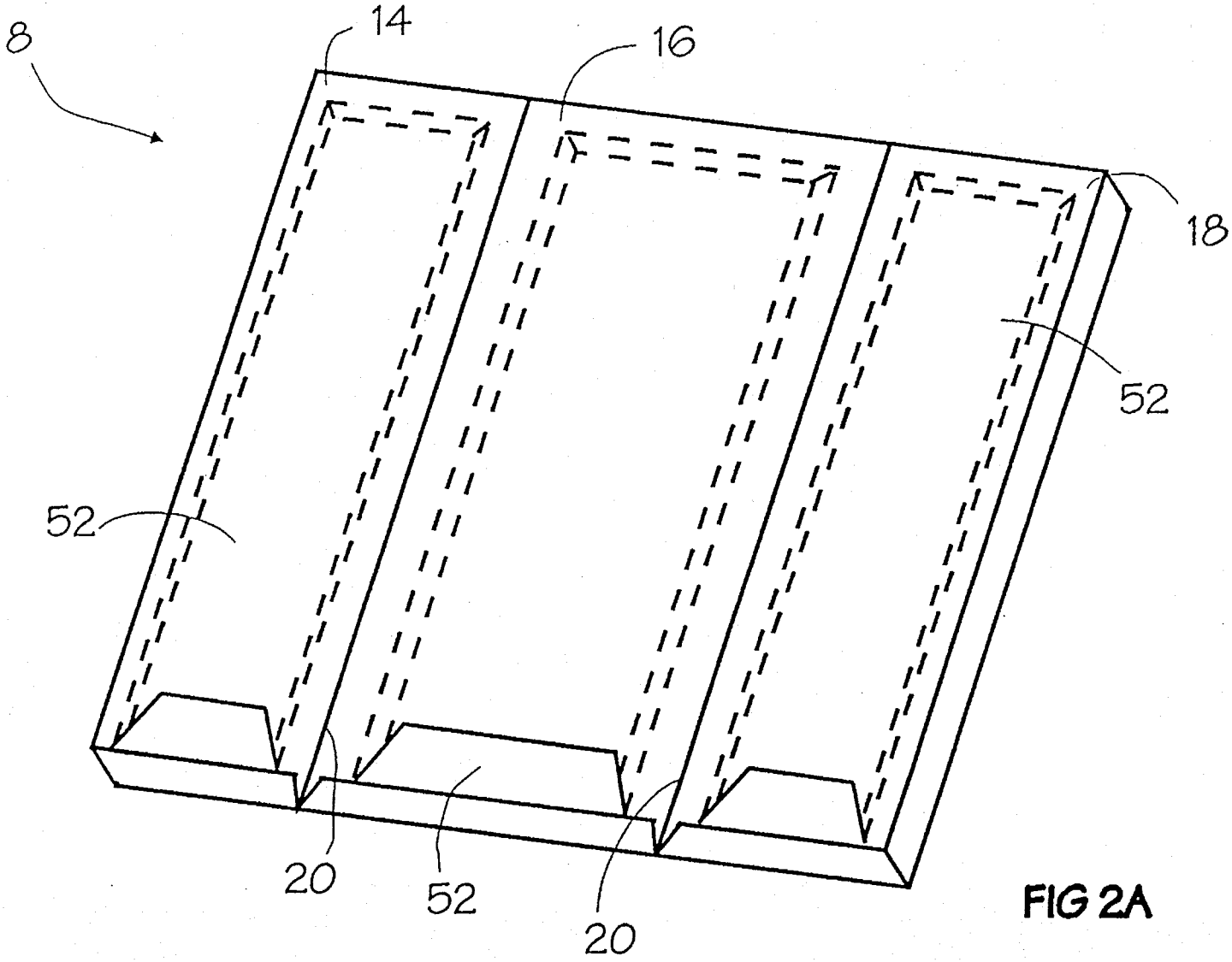
FIGS. 2*a* and 2*b*: illustrate, in plan view, the top and bottom sections of the multipurpose bag of FIG. 1.
Figure 2B:
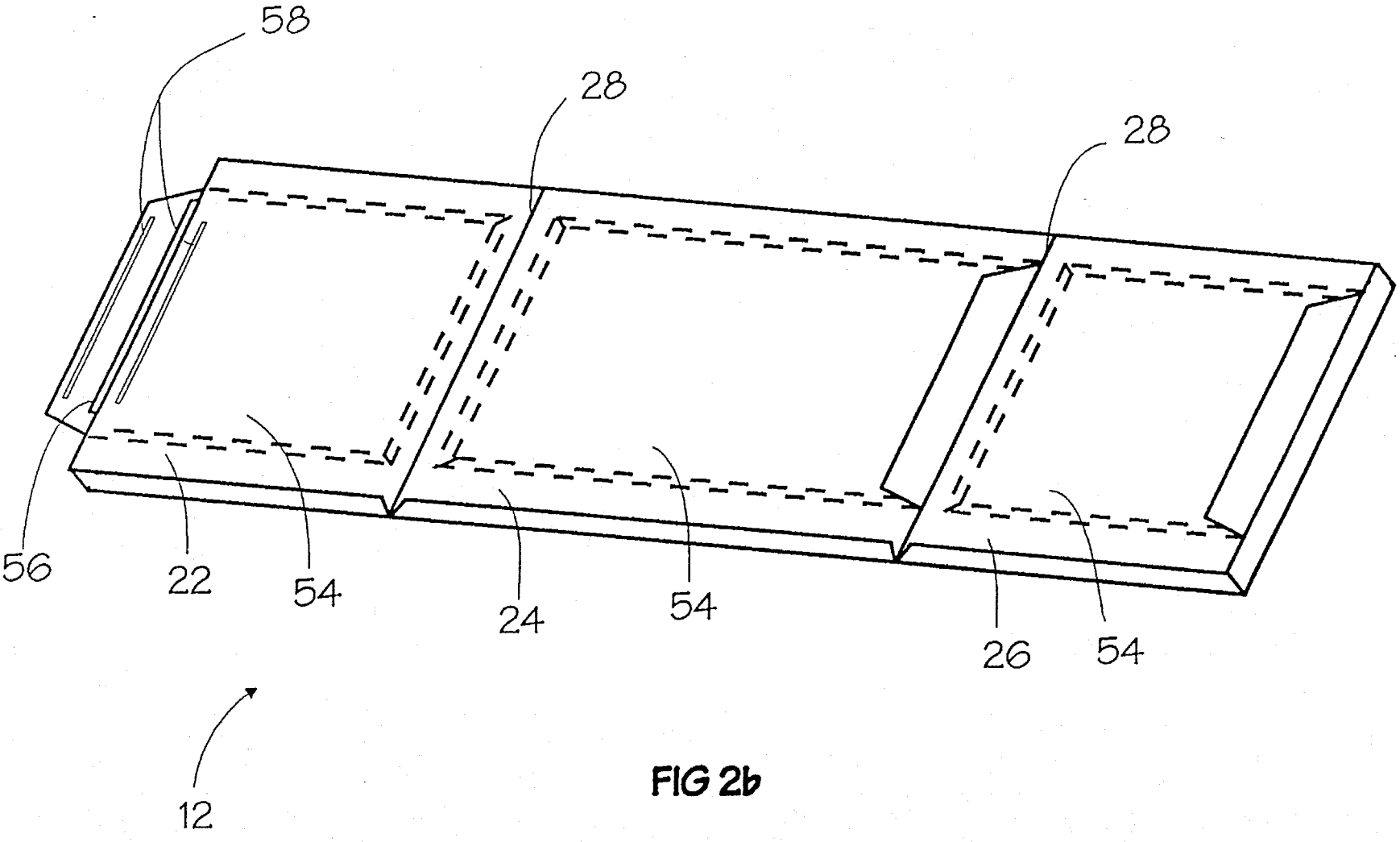
Figure 3:
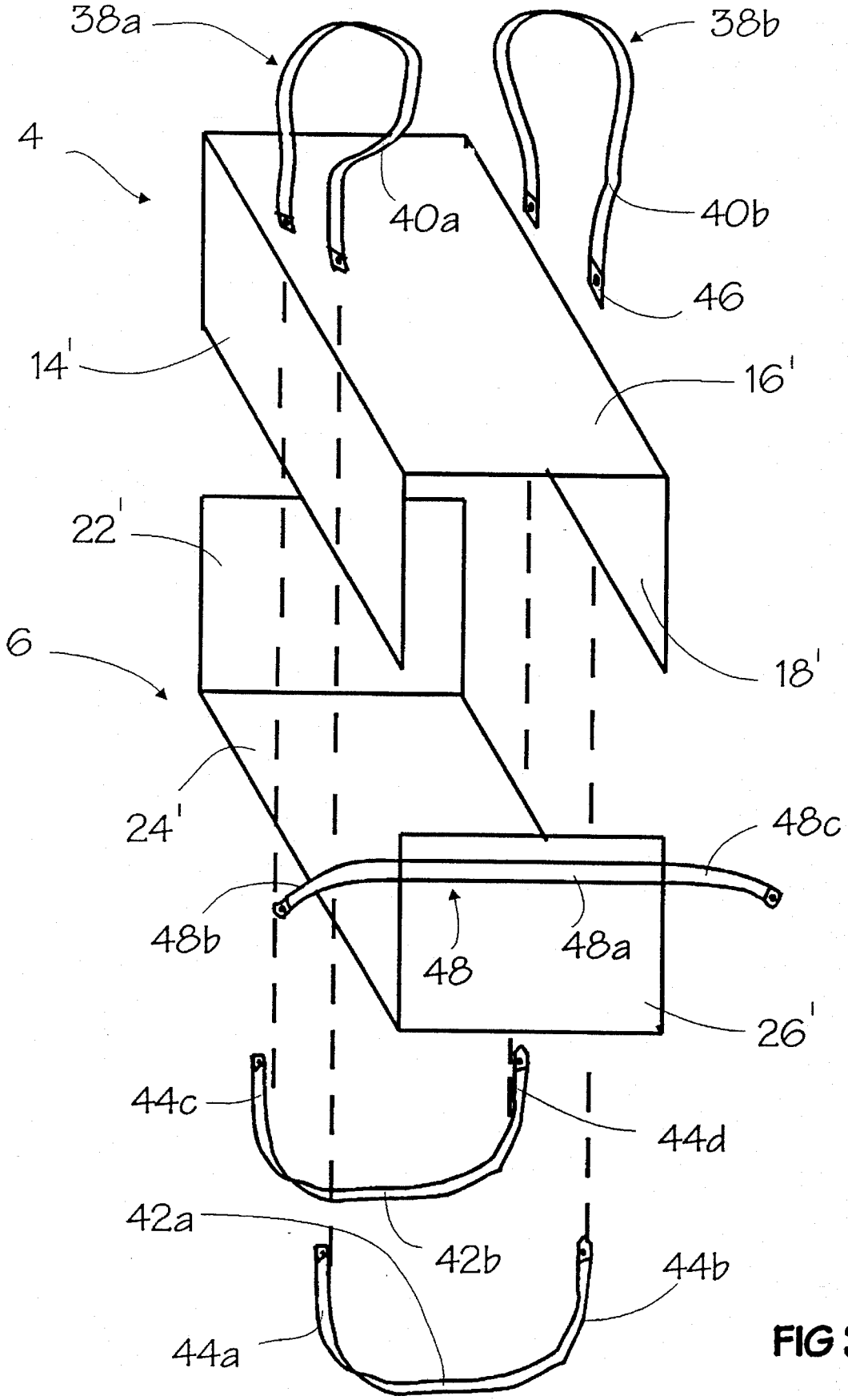
FIG. 3: illustrates, in an exploded perspective view, the multipurpose bag of FIG. 1.

FIG. 1 shows a bag 2 which includes a top section 4 fastened to a bottom section 6. When the top section 4 and the bottom section 6 are separated from one another as shown in FIG. 3, the top section 4 may be converted to a mattress 8 (FIG. 2*a*), whereas the bottom section 6 may be converted to a chair 10 (FIG. 4) or a second mattress 12 (FIG. 2*b*). Therefore, the bag 2 can be converted into both a mattress 8 and a chair 10 or into two mattresses, 8 and 12. Preferably, the bag 2 is made of pliable material which is soft, resilient and can flex under pressure, such as polyester or nylon. This is important in canoe-camping when travelling under rough conditions as a rigid container will likely move around in the canoe and therefore increase the risk for the canoe to capsize.

The shape of the top section 4 and the bottom section 6 will depend on the overall shape of the bag 2. For example, the top and bottom sections 4 and 6 would have corresponding square shapes if the bag 2 is to be cubical. However, if the bag 2 is to have an elongated shape, as shown in FIG. 1, one section will necessarily be longer and narrower than the other section. FIG. 3 shows the sections in the folded position whereby the sections are generally U-shaped and complement one another so as to provide a generally rectangular bag 2 when the top and bottom sections 4 and 6 are fastened to one another. Referring to FIGS. 2*a* and 3, the top section 4 is generally rectangular in shape and is divided into three areas: a first top area 14, a second top area 16 and a third top area 18. The first top area 14 and the third top area 18 are substantially equal in size. The first top area 14 and third top area 18 form the sides 14' and 18' of the bag 2, whereas the top second area 16 forms the top 16' of the bag 2. The top areas 14, 16 and 18 are separated by a pair of top fold lines 20. The fold lines 20 are spaced apart and parallel to one another. They extend along the longitudinal axis of the bag 2. The fold lines 20 are provided by, for example, stitching. However, they may also be imaginary lines in that they merely indicate the locations at which the section 4 may be folded. Referring to FIGS. 2*b* and 3, the bottom section 6 is generally rectangular in shape. The bottom section 6 is longer and narrower than the top section 4. However, it will be recognized by those skilled in the art that the bag 2 may also be obtained with the top section 4 being longer and narrower than the bottom section 6. The bottom section 6 includes a first bottom area 22, a second bottom area 24 and a third bottom area 26, the first and third bottom areas 22 and 26 being substantially equal in size. The first bottom area 22 and the third bottom area 26 form the end sections 22' and 26' of the bag 2, whereas the second bottom area 24 forms the bottom 24' of the bag 2. Each of the bottom areas 22, 24 and 26 are separated by a pair of bottom fold lines 28. Similarly to the top fold lines 20, the bottom fold lines 28 are spaced apart and parallel to one another and may be provided by stitching or be imaginary. The bottom fold lines 28 extend transversely to the longitudinal axis of the bag 2. However if the bag 2 is obtained with the top section 4 being longer and narrower than the bottom section 6, than the bottom fold lines 28 will obviously extend along the longitudinal axis of the bag 2 and the top fold lines 20 will extend transversely to the longitudinal axis of the bag 2.

As shown in FIG. 1, fastening means 30 are provided for fastening the top section 4 to the bottom section 6 along their periphery. Preferably, the fastening means 30 is a zipper which includes at least one slide fastener 32 and a pair of zipper chains 34, each zipper chain 34 extending along the entire outer peripheral edge of each of the sections 4 and 6. Preferably, the starting point of the slide fastener 32 is located centrally along the length of the bag 2 and the ending point of the slide fastener 32 is situated next to its starting point so as to provide a tightly sealed enclosure when the bag 2 is closed.

Figure 4:
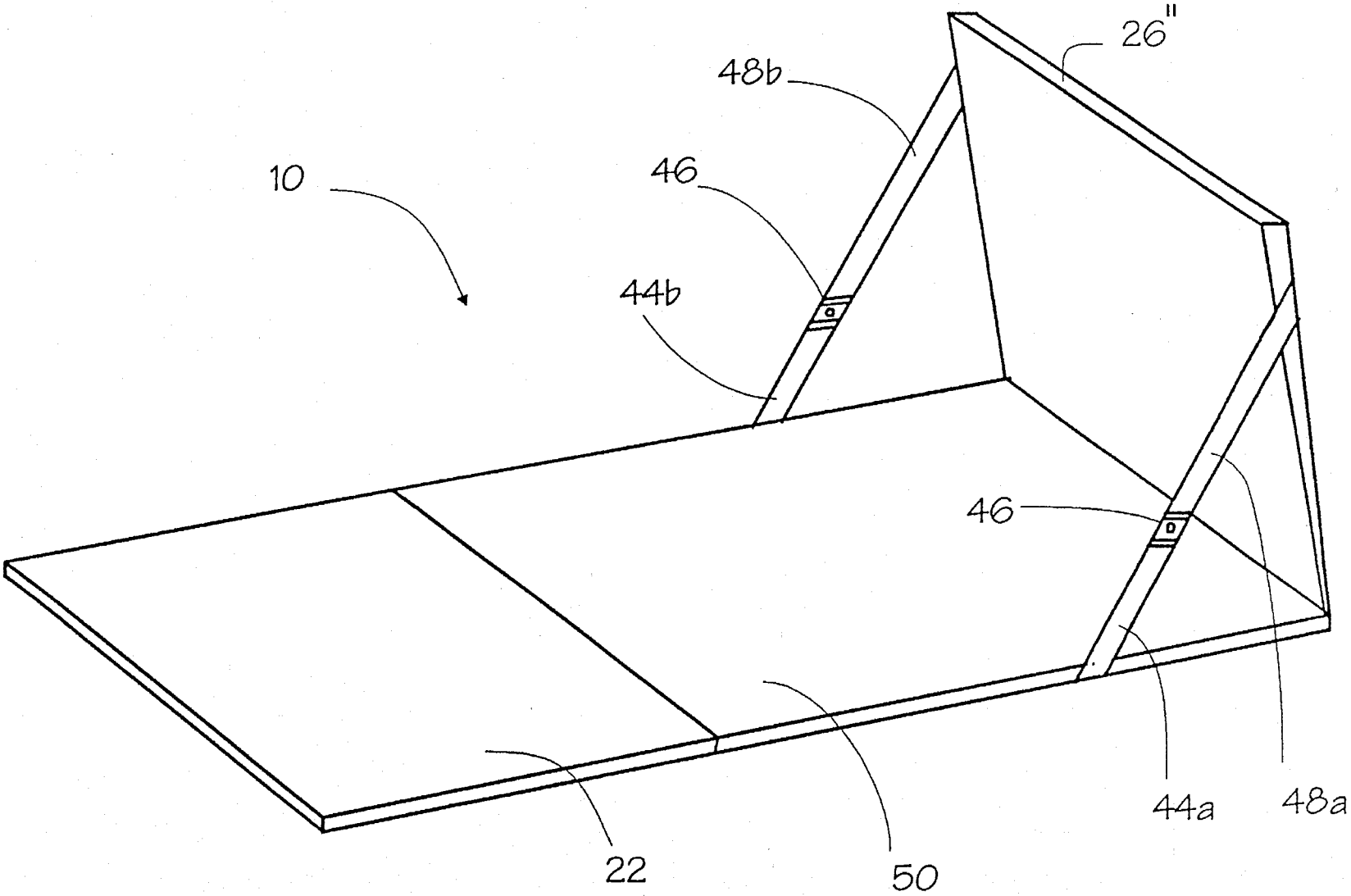
FIG. 4: illustrates, in a perspective view, the chair configuration of the multipurpose bag of FIG. 1.

The bag 2 further includes strap means 36 disposed on the second bottom area 24 of the bottom section 6 to provide a pair of handles 38*a*, 38*b*. The strap means 36 comprise removable handle portions 40*a*, 40*b*, intermediate strap portions 42*a*, 42*b* and end portions 44*a*, 44*b*, 44*c*, 44*d*. The strap portion 42*a* is intermediate the end portions 44*a* and 44*b*, whereas the strap portion 42*b* is intermediate the end portions 44*c* and 44*d*. Each of the strap portions 42*a* and 42*b* is stitched, preferably along its entire length, on the outer face of the second bottom area 24. Alternatively, there may be two or more strap loop(s) (not shown) on the outer face of the second bottom area for receiving the strap portions 42*a* and 42*b*. Preferably the strap portions 42*a* and 42*b* are located generally at ¼ and ¾ of the length of the bottom section 6 so as to distribute the weight of the bag 2 evenly when the bag 2 is carried by the handles 38*a*, 38*b*. The length of each of the end portions 44*a*, 44*b*, 44*c*, 44*d* is half that of the width of the bag 2 so that they may be stowed away as described below. The end portions 44*a*, 44*b*, 44*c*, 44*d* are loose and may be brought up the side of the bag 2 to be connected to the handle portions 40*a*, 40*b* by connectors 46, such as by buckles or snaps. More specifically, the end portions 44*a*, 44*b* may be connected to the handle portion 40*a* and the end portions 44*c*, 44*d* may be connected to handle portion 40*b* to form handles 38*a*, 38*b* respectively. The end portions 44*a*, 44*b*, 44*c*, 44*d* may also be stowed away by connecting the end portion 44*a*, to the end portion 44*b* and the end portion 44*c*, to the end portion 44*d* underneath the bag 2 (not shown). In the embodiment shown, all the connectors are of the type which include a male half and a female half, and therefore, the male half of one connector may be connected with the female half of another connector. The bag 2 further comprises a side strap 48 disposed on the third bottom area 26. FIGS. 1 and 4 show the side strap 48 as being on the outer face of the third bottom area 26, however, it may also be disposed on the inner face of the third bottom area 26. The side strap 48 includes a strap portion 48*a* and end portions 48*b*, 48*c*. The strap portion 48*a* is stitched, preferably along its entire length, to the third bottom area 26. To convert the bottom section 6 into a chair 10, as shown in FIG. 4, the handle portion 40*a* is removed and replaced by the side strap 48, i.e. the end portion 44*a*, is connected to the end portion 48*b* and the end portion 44*b* is connected to the end portion 48*c*. Alternatively, the chair 10 may be obtained by connecting the end portion 44*c*, to 48*b* and 44*d* to 48*c*.

This will bring the third bottom area 26 generally perpendicular to the second bottom area 24, whereby the third bottom area 26 becomes the back 26" of the chair 10 and the second bottom area 24 becomes the seat 50 of the chair. The chair 10 should be strong enough to support an individual without folding. For that purpose, the side strap 48 is located generally at or about the position at which the force is applied when a person leans back against the back 26" of the chair 10. When the bottom section 6 is not in the chair configuration, the end portions 48*b*, 48*c* may be stowed away by connected them to one another on the side 26' of the bag 2 as shown in FIG. 1.

The top areas 14, 16, 18 are provided with top pockets 52 (FIG. 2*a*) which are disposed on the inner face thereof by, for example, stitching. However the top pockets 52 may also be disposed on the outer face of the top areas 14, 16, 18. In the same manner, the bottom areas 22, 24, 26 are provided with bottom pockets 54 (FIG. 2*b*). The pockets 52, 54 may be opened, for example, along one edge thereof, and into which may be positioned one or more insert(s) 56.

The material of which the inserts 56 consist may vary to match the specific activity for which the bag 2 is to be used. For example, in canoe-camping or when the mattresses 8, 12 and the chair 10 are to be used in the water, the inserts 56 are preferably made of flotation material such as polyethylene foams (low density polyethylene) which will permit the bag 2 to float and be recovered in the event the boat capsizes. It is well known to a person skilled in the art that the degree of density of the foam is inversely proportional to its degree of flotation. Moreover, for a given foam density, the degree of flotation of the bag, chair or mattresses will depend on the weight of the bag or the weight of the individual using the chair or mattresses. Therefore, the degree of density of the foam insert should be chosen as a function of the weight of the bag and/or the weight of the individual using the chair or mattresses. Generally, polyethylene foam (low density polyethylene) provides adequate flotation means for the average person. Alternatively, the insert 56 may simply be made of a quilted material to provide the desired cushioning function or a foam rubber to provide thermal insulation and shock absorption functions. When the bottom section 6 is to be used as a chair, it is recommended that a layer of high density polyethylene be inserted in the bottom pockets 54 of at least the second and third bottom 15 areas 24, 26 to provide rigidity to the chair. Thereafter, the pockets 52 and 54 may be closed by closing means 58, such as "VELCRO" zippers or buttons The closing means 58 are practical in that they allow the user to replace the insert 56 at will. This is important when the chair or mattresses are used in water, as the efficiency of the polyethylene foam to float decreases with time.

Preferably the top and bottom sections 4 and 6 are made of materials which are strong, lightweight and which do not shrink in water, such as polyester or nylon. The slide faster 32 and zipper chains 34 may be made of nylon and the connectors 46 may be made of plastic. Preferably all the components of the bag 2 are non-metallic to prevent rusting.

While the foregoing embodiment of the invention have been described and shown, it is understood that all alternatives and modifications may be made thereto and fall within the scope of the invention.

I claim:

1. A multipurpose bag comprising:

a top section convertible to a first mattress comprising spaced apart first and second parallel fold lines defining a first, second and third top area, said second top area being disposed between said first and third top area, said first top area having substantially the same size and shape as said third top area, said top section includes a first perimeter;

a bottom section convertible to a chair or a second mattress comprising spaced apart third and fourth parallel fold lines defining a first, second and third bottom area, said third bottom area having an upper end, said second bottom area being disposed between said first and third bottom area, said first bottom area having substantially the same size and shape as said third bottom area, said bottom section includes a second perimeter;

fastening means disposed along the first and second perimeters for fastening said top section to said bottom section so as to form a bag;

strap means including removable handle portions for carrying said bag and strap portions disposed on said second bottom area; and a side strap disposed on the upper end of said third bottom area for connecting to said strap means so as to retain said third bottom area in a generally perpendicular position relative to said first and second bottom areas to form a chair, said side strap and strap means being sufficiently strong and disposed in such a manner as to prevent said chair from folding when in use.

2. A multipurpose bag as claimed in claim 1 further comprising top and bottom pockets disposed on the top and bottom areas for receiving insert material.

3. A multipurpose bag as claimed in claim 2 wherein the insert material is low density polyethylene to provide a floatable bag.

4. A multipurpose bag comprising:

a generally U-shaped top section convertible to a first mattress comprising a planar top and foldable planar top sides extending downwardly from said planar top, said top sides having substantially the same size and shape, said top section includes a first perimeter;

a generally U-shaped bottom section convertible to a chair or a second mattress comprising a planar bottom and foldable first and second planar bottom sides extending upwardly from said planar bottom, said foldable first and second planar bottom sides having substantially the same size and shape, said second foldable planar bottom side having an upper end, said bottom section includes a second perimeter;

wherein said bottom and top sections complement one another so as to provide a generally parallelepiped enclosure;

fastening means disposed along the first and second perimeters for fastening said top section to said bottom section so as to form a bag;

strap means including removable handle portions for carrying said bag and strap portions disposed on said planar bottom; and a side strap disposed on the upper end of said second foldable planar bottom side for connecting to said strap means so as to retain said second foldable planar bottom side in a generally perpendicular position relative to said planar bottom to form a chair, said side strap and strap means being sufficiently strong and disposed in such a manner as to prevent said chair from folding when in use.

5. A multipurpose bag as claimed in claim 4 further comprising top and bottom pockets disposed on the top and bottom and sides thereof for receiving insert material.

6. A multipurpose bag as claimed in claim 4 wherein the insert material is low density polyethylene to provide a floatable bag.

7. A multipurpose bag comprising:

a top section convertible to a first mattress comprising spaced apart first and second parallel fold lines defining a first, second and third top area, said second top area being disposed between said first and third top area, said first top area having substantially the same size and shape as said third top area, said top section having a first perimeter;

a bottom section convertible to a second mattress separate from said first, said bottom section comprising spaced apart third and fourth parallel fold lines defining a first, second and third bottom area, said second bottom area being disposed between said first and third bottom area, said first bottom area having substantially the same size and shape as said third bottom area said bottom area having substantially the same size and shape as said second top area said bottom section having a second perimeter of length substantially the same as the length of said first perimeter;

fastening means disposed along the first and second perimeters for fastening said top section to said bottom section so as to form a bag and, when unfastened, for detaching completely said first mattress from said second mattress; and strap means for carrying said bag disposed on said second bottom area.

8. A multipurpose bag as claimed in claim 7 further comprising top and bottom pockets disposed on the top and bottom areas for receiving insert material.

9. A multipurpose bag as claimed in claim 7 wherein the insert material is low density polyethylene to provide a floatable bag.

* * * * *